US011515658B2

(12) United States Patent
Li

(10) Patent No.: US 11,515,658 B2
(45) Date of Patent: Nov. 29, 2022

(54) ELECTRIC SHOCK-PROOF PLUG AND AN ELECTRICAL EQUIPMENT

(71) Applicant: Xiamen Longstar Lighting Co., Ltd., Fujian (CN)

(72) Inventor: Xilong Li, Fujian (CN)

(73) Assignee: Xiamen Longstar Lighting Co., Ltd., Xiamen (CN)

( * ) Notice: Subject to any disclaimer, the term of this patent is extended or adjusted under 35 U.S.C. 154(b) by 0 days.

(21) Appl. No.: 17/358,085

(22) Filed: Jun. 25, 2021

(65) Prior Publication Data

US 2022/0115804 A1 Apr. 14, 2022

(30) Foreign Application Priority Data

Oct. 12, 2020 (CN) ..... 202022259338.2

(51) Int. Cl.
*H01R 13/453* (2006.01)
*H01R 13/44* (2006.01)

(52) U.S. Cl.
CPC ..... *H01R 13/4538* (2013.01); *H01R 13/44* (2013.01)

(58) Field of Classification Search
None
See application file for complete search history.

(56) References Cited

U.S. PATENT DOCUMENTS 2,490,580 A * 12/1949 Colla, Jr. ..... H01R 13/635 439/131
3,926,494 A * 12/1975 Maillaro ..... H01R 13/4538 439/131

* cited by examiner

*Primary Examiner* — Ross N Gushi
(74) *Attorney, Agent, or Firm* — Cooper Legal Group, LLC

(57) ABSTRACT

The present disclosure discloses an electric shock-proof plug that comprises an insulating sleeve, a plug body, and a reset member. The plug body is movably disposed in the insulating sleeve. An inner wall of the insulating sleeve comprises a guiding groove, and an outer wall of the plug body comprises a sliding member movably coupled to the guiding groove. The sliding member moves in the guiding groove to drive the plug body to move between a high position and a low position. When the plug body moves to the low position, a connector of the plug body is exposed out of the insulating sleeve, and the reset member generates an elastic resetting force. When the plug body moves to the high position, the connector is retracted back into the insulating sleeve. A user will be prevented from getting an electric shock when unplugging the electric shock-proof plug.

17 Claims, 3 Drawing Sheets

ELECTRIC SHOCK-PROOF PLUG AND AN ELECTRICAL EQUIPMENT

RELATED APPLICATIONS

This application claims priority to Chinese patent application number 202022259338.2, filed on Oct. 12, 2020. Chinese patent application number 202022259338.2 is incorporated herein by reference.

FIELD OF THE DISCLOSURE

The present disclosure relates to electrical equipment, and in particular to a plug.

BACKGROUND OF THE DISCLOSURE

At present, the energization of electrical equipment has a plugging step of directly inserting a plug into a power supply hole of a power supply socket to electrically connect the electrical equipment to a power supply. The power supply socket is connected to a power supply source and will remain energized. Although this plugging step is easy to perform, manually inserting the plug into the power supply hole may generate an electric arc, which may cause an electric shock. In addition, when the electrical equipment is not in use, the plug is often pulled out from the power supply hole, which will cause the power supply hole to be exposed. When a child inserts his/her finger or a metal rod directly into the power supply hole of the power supply socket, it will cause an electric shock accident and even endanger the child's life, which is a great potential risk. Further, when the plug is manually pulled out, not only is a large force needed, but also an electric arc may be generated, which may cause an electric shock.

BRIEF SUMMARY OF THE DISCLOSURE

The present disclosure provides an electric shock-proof plug to avoid electric shock accidents when a user unplugs the electric shock-proof plug.

In order to solve the technical problem, a first technical solution of the present disclosure is as follows.

An electric shock-proof plug comprises an insulating sleeve, a plug body, and a reset member. The plug body is movably disposed in the insulating sleeve. An inner wall of the insulating sleeve comprises a guiding groove, and an outer wall of the plug body comprises a sliding member movably coupled to the guiding groove. The sliding member moves in the guiding groove to drive the plug body to move relative to insulating sleeve and to move between a high position and a low position. When the plug body moves to the low position, a connector of the plug body is exposed out of the insulating sleeve, and the reset member is biased by the plug body to generate an elastic resetting force. When the plug body moves to the high position, the connector of the plug body is retracted back into the insulating sleeve.

In a preferred embodiment, the outer wall of the plug body comprises a circular groove extending along a circumferential direction of the plug body, and the sliding member is a ball configured to roll in the circular groove.

In a preferred embodiment, the guiding groove comprises a highest point, a lowest point, and a middle point located between the highest point and the lowest point.

In a preferred embodiment, when the sliding member is positioned at the highest point, the connector of the plug body is retracted back into the insulating sleeve. When the sliding member is positioned at the middle point, the connector of the plug body is exposed out of the insulating sleeve.

In a preferred embodiment, the lowest point is disposed between the highest point and middle point along an extending direction of the guiding groove.

In a preferred embodiment, the reset member is a spring, a first end of the reset member abuts a lower end surface of the plug body, and a second end of the reset member abuts the insulating sleeve.

In a preferred embodiment, the plug body comprises a first portion and a second portion disposed on a lower end of the first portion and extending along an axial direction of the first portion, a diameter of the second portion is smaller than a diameter of the first portion, and the lower end surface of the plug body is defined by an area extending outward from the lower end of the first portion relative to the second portion.

In a preferred embodiment, a lower end of the insulating sleeve extends radially inward to define a ring wall, and the second end of the reset member abuts an upper surface of the ring wall.

A second technical solution of the present disclosure is as follows.

An electrical equipment comprises the electric shock-proof plug.

In a preferred embodiment, the electric shock-proof plug is connected to the electrical equipment body through a wire, or the electric shock-proof plug is directly disposed on the electrical equipment body.

Compared with the existing techniques, the technical solution has the following advantages.

When a user unplugs the electric shock-proof plug, the insulating sleeve moves relative to the plug body to drive the connector of the plug body to be retracted back into the insulating sleeve. In this way, the user will not receive an electric shock when unplugging the electric shock-proof plug.

DETAILED DESCRIPTION OF THE EMBODIMENTS

Figure 1:
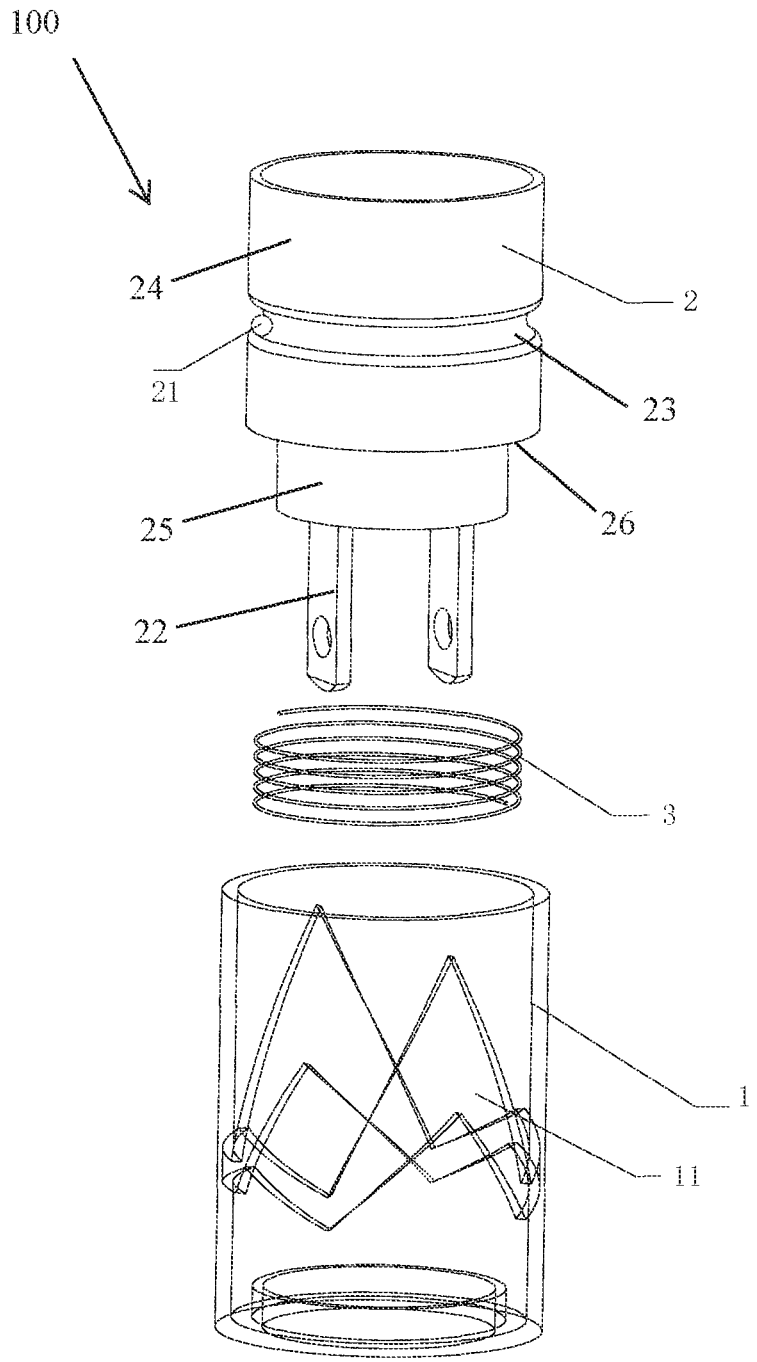
FIG. 1 illustrates an exploded view of an electric shock-proof plug in a preferred embodiment of the disclosure.

The present disclosure will be further described below in combination with the accompanying drawings and embodiments.

The following will clearly and completely describe the technical solutions in the embodiments of the present disclosure with reference to the accompanying drawings. Obviously, the described embodiments are only a portion of the embodiments of the present disclosure, and not all of the embodiments. Based on the embodiments of the present disclosure, all other embodiments obtained by those of ordinary skill in the art without creative work fall within the protection scope of the present disclosure.

In the description of the present disclosure, it should be noted that the terms "upper", "lower", "inner", "outer", "top/bottom", etc. indicate the orientation or positional relationship based on the orientation shown in the drawings. The positional relationship is only for the convenience of describing the present disclosure and simplifying the description, rather than indicating or implying that the pointed device or element must have a specific orientation, be constructed, and be operated in a specific orientation. Therefore, the positional relationship should not be understood as a limitation of the present disclosure. In addition, the terms "first" and "second" are only used for descriptive purposes and should not be understood as indicating or implying relative importance.

In the description of the present disclosure, it should be noted that the terms "installed", "provided with", "sleeved/connected", "connected", etc., should be understood broadly. For example, "connected" can be a fixed connection, a detachable connection, or an integral connection, a mechanical connection, an electrical connection, a direct connection, or an indirect connection through an intermediate medium, and it can be a connection between two members. For those of ordinary skill in the art, the specific meaning of the above terms in the present disclosure can be understood under specific conditions.

Figure 2:
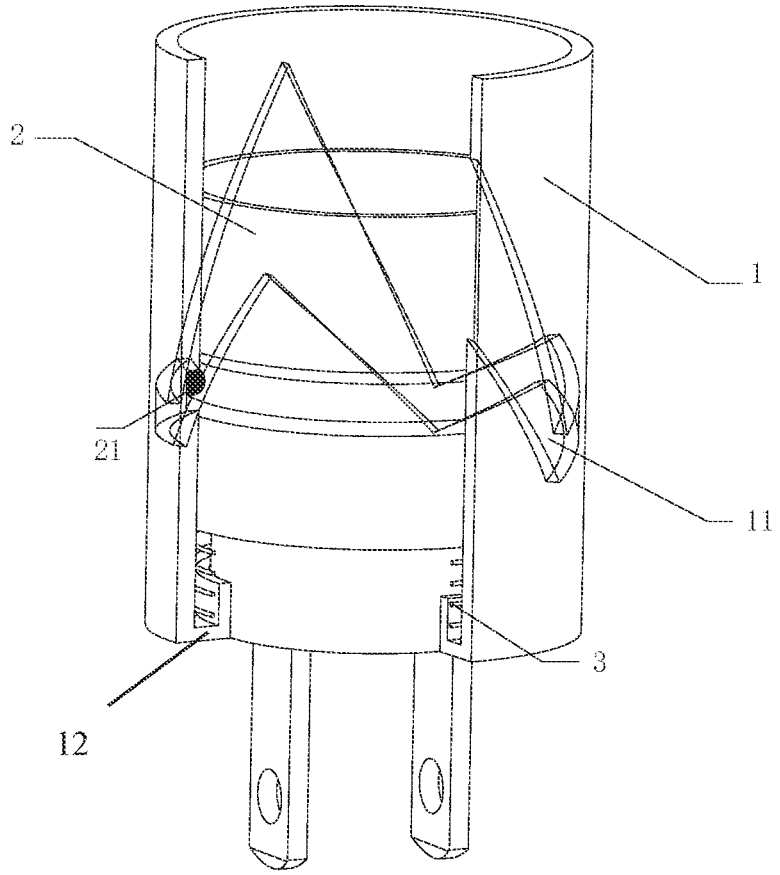
FIG. 2 illustrates a perspective view of the electric shock-proof plug in the preferred embodiment with a section of an exterior of the electric shock-proof plug removed.
Figure 3:
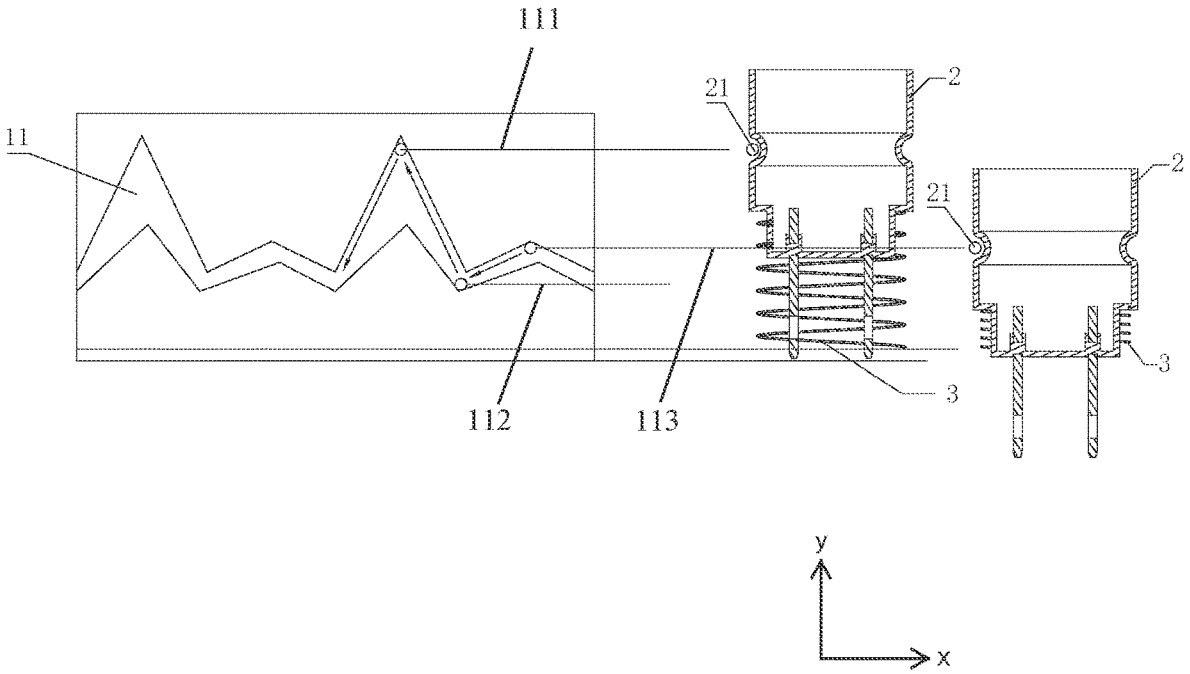
FIG. 3 illustrates a schematic diagram of the electric shock-proof plug in different positions in the preferred embodiment.

Referring to FIGS. 1 to 3, an embodiment of an electric shock-proof plug 100 is provided. The electric shock-proof plug 100 comprises an insulating sleeve 1, a plug body 2, and a reset member 3.

The plug body 2 is movably disposed in the insulating sleeve 1. An inner wall of the insulating sleeve 1 comprises a guiding groove 11, and an outer wall of the plug body 2 comprises a sliding member 21 which is movably coupled to the guiding groove 11. The sliding member 21 moves in the guiding groove 11 to drive the plug body 2 to move relative to the insulating sleeve 1 to move between a high position (i.e., a first position) and a low position (i.e., a second position).

When the plug body 2 moves to the low position, a connector 22 of the plug body 2 is exposed out of the insulating sleeve 1, and the reset member 3 is biased by the plug body 2 to generate an elastic resetting force. When the plug body 2 moves to the high position, the connector 22 of the plug body 2 is retracted back into the insulating sleeve 1.

When a user unplugs the electric shock-proof plug 100, the insulating sleeve 1 moves relative to the plug body 2 due to an external force to drive the plug body 2 to move from the low position to the high position and to drive the connector 22 of the plug body 2 to be retracted back into the insulating sleeve 1. In this way, the user will not get an electric shock when unplugging the electric shock-proof plug 100.

In order to realize the above-mentioned working process, this embodiment comprises the following specific structure.

The outer wall of the plug body 2 comprises a circular groove 23 extending along a circumferential direction of the plug body 2, and the sliding member 21 is a ball and rolls in the circular groove 23. The guiding groove 11 comprises a highest point 111, a lowest point 112, and a middle point 113 located between the highest point 111 and the lowest point 112 (e.g., measured by a y-axis in FIG. 3). When the sliding member 21 (i.e., the ball) is positioned at the highest point 111, the connector 22 of the plug body 2 is retracted back into the insulating sleeve 1. When the sliding member 21 is positioned at the middle point 113, the connector 22 of the plug body 2 is exposed out of the insulating sleeve 1. That is, the middle point 113 corresponds to the low position of the plug body 2, the highest point 111 corresponds to the high position, and the lowest point 112 is disposed between the highest point 111 and middle point 113 along an extending direction (e.g., measured by an x-axis in the FIG. 3) of the guiding groove 11. The plug body 2 initially moves out of the insulating sleeve 1 for a certain distance due to the lowest point 112 before being retracted back into the insulating sleeve 1, which enables the reset member 3 to generate a sufficient elastic resetting force.

In this embodiment, the reset member 3 is a spring. A first end of the reset member 3 abuts a lower end surface of the plug body 2, and a second end of the reset member 3 abuts the insulating sleeve 1.

The plug body 2 comprises a first portion 24 and a second portion 25 disposed on a lower end of the first portion 24 and extending along an axial direction of the first portion 24. A diameter of the second portion 25 is smaller than a diameter of the first portion 24, and the lower end surface of the plug body 2 is defined by an area 26 extending outward from the lower end of the first portion 24 relative to the second portion 25. A lower end of the insulating sleeve 1 extends radially inward to define a ring wall 12, and the second end of the reset member 3 abuts an upper surface of the ring wall 12.

In this embodiment, an electrical equipment is provided and comprises an electrical equipment body and the electric shock-proof plug 100 as described above. The electric shock-proof plug 100 is connected to the electrical equipment body through a wire, or the electric shock-proof plug 100 is directly disposed on the electrical equipment body.

It will be apparent to those skilled in the art that various modifications and variation can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. An electric shock-proof plug, comprising:
an insulating sleeve,
a plug body, and
a reset member, wherein:
the plug body is movably disposed in the insulating sleeve,
an inner wall of the insulating sleeve comprises a guiding groove,
an outer wall of the plug body comprises a sliding member movably coupled to the guiding groove,
the sliding member moves in the guiding groove to drive the plug body to move relative to the insulating sleeve and to move between a high position and a low position,
the outer wall of the plug body comprises a circular groove extending along a circumferential direction of the plug body,
the sliding member is a ball configured to roll in the circular groove,
when the plug body moves to the low position:
a connector of the plug body is exposed out of the insulating sleeve, and
the reset member is biased by the plug body to generate an elastic resetting force, and
when the plug body moves to the high position, the connector of the plug body is retracted back into the insulating sleeve.

2. The electric shock-proof plug according claim 1, wherein:

the guiding groove comprises a highest point, a lowest point, and a middle point located between the highest point and the lowest point in a direction perpendicular to a longest dimension of the guiding groove.

3. The electric shock-proof plug according claim 2, wherein:

when the sliding member is positioned at the highest point, the connector of the plug body is retracted back into the insulating sleeve, and when the sliding member is positioned at the middle point, the connector of the plug body is exposed out of the insulating sleeve.

4. The electric shock-proof plug according claim 3, wherein:

the lowest point is disposed between the highest point and middle point along the guiding groove in a direction of the longest dimension of the guiding groove.

5. The electric shock-proof plug according claim 4, wherein:

the reset member is a spring, a first end of the reset member abuts a lower end surface of the plug body, and a second end of the reset member abuts the insulating sleeve.

6. The electric shock-proof plug according claim 5, wherein:

the plug body comprises a first portion and a second portion disposed on a lower end of the first portion and extending along an axial direction of the first portion, a diameter of the second portion is smaller than a diameter of the first portion, and the lower end surface of the plug body is defined by an area extending outward from the lower end of the first portion relative to the second portion.

7. The electric shock-proof plug according claim 6, wherein:

a lower end of the insulating sleeve extends radially inward to define a ring wall, and the second end of the reset member abuts an upper surface of the ring wall.

8. An electrical equipment, comprising:

an electrical equipment body, and an electric shock-proof plug, wherein:

the electric shock-proof plug comprises an insulating sleeve, a plug body, and a reset member, the plug body is movably disposed in the insulating sleeve, an inner wall of the insulating sleeve comprises a guiding groove, an outer wall of the plug body comprises a sliding member movably coupled to the guiding groove, the sliding member moves in the guiding groove to drive the plug body to move relative to the insulating sleeve and to move between a high position and a low position, the outer wall of the plug body comprises a circular groove extending along a circumferential direction of the plug body, the sliding member is a ball configured to roll in the circular groove, when the plug body moves to the low position:

a connector of the plug body is exposed out of the insulating sleeve, and the reset member is biased by the plug body to generate an elastic resetting force, and when the plug body moves to the high position, the connector of the plug body is retracted back into the insulating sleeve.

9. The electrical equipment according claim 8, wherein:

the guiding groove comprises a highest point, a lowest point, and a middle point located between the highest point and the lowest point in a direction perpendicular to a longest dimension of the guiding groove.

10. The electrical equipment according claim 9, wherein:

the electric shock-proof plug is connected to the electrical equipment body through a wire, or the electric shock-proof plug is directly disposed on the electrical equipment body.

11. The electrical equipment according claim 9, wherein:

when the sliding member is positioned at the highest point, the connector of the plug body is retracted back into the insulating sleeve, and when the sliding member is positioned at the middle point, the connector of the plug body is exposed out of the insulating sleeve.

12. The electrical equipment according claim 11, wherein:

the electric shock-proof plug is connected to the electrical equipment body through a wire, or the electric shock-proof plug is directly disposed on the electrical equipment body.

13. The electrical equipment according claim 11, wherein:

the lowest point is disposed between the highest point and middle point along the guiding groove in a direction of the longest dimension of the guiding groove.

14. The electrical equipment according claim 13, wherein:

the reset member is a spring, a first end of the reset member abuts a lower end surface of the plug body, and a second end of the reset member abuts the insulating sleeve.

15. The electrical equipment according claim 14, wherein:

the plug body comprises a first portion and a second portion disposed on a lower end of the first portion and extending along an axial direction of the first portion, a diameter of the second portion is smaller than a diameter of the first portion, and the lower end surface of the plug body is defined by an area extending outward from the lower end of the first portion relative to the second portion.

16. The electrical equipment according claim 15, wherein:

a lower end of the insulating sleeve extends radially inward to define a ring wall, and the second end of the reset member abuts an upper surface of the ring wall.

17. The electrical equipment according claim 8, wherein:

the electric shock-proof plug is connected to the electrical equipment body through a wire, or the electric shock-proof plug is directly disposed on the electrical equipment body.

* * * * *